US010683639B2

(12) United States Patent
Cho et al.

(10) Patent No.: US 10,683,639 B2
(45) Date of Patent: Jun. 16, 2020

(54) ACTUATOR

(71) Applicant: KOREA INSTITUTE OF INDUSTRIAL TECHNOLOGY, Cheonan-si, Chungcheongnam-do (KR)

(72) Inventors: Jung San Cho, Cheonan-si (KR); Sang Deok Park, Anyang-si (KR); Byung Yun Park, Siheung-si (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 165 days.

(21) Appl. No.: 15/835,686

(22) Filed: Dec. 8, 2017

(65) Prior Publication Data

US 2018/0163371 A1 Jun. 14, 2018

(30) Foreign Application Priority Data

Dec. 9, 2016 (KR) ..... 10-2016-0167315

(51) Int. Cl.
*E02F 9/22* (2006.01)
*F15B 15/14* (2006.01)
(Continued)

(52) U.S. Cl.
CPC ..... *E02F 9/2203* (2013.01); *E02F 9/226* (2013.01); *F15B 15/061* (2013.01);
(Continued)

(58) Field of Classification Search
CPC ..... F16J 15/52; F15B 15/084; F15B 15/1442; F15B 15/1452; F15B 15/1461
See application file for complete search history.

(56) References Cited

U.S. PATENT DOCUMENTS 214,764 A * 4/1879 Fagan ..... F16J 15/52 74/18.2
901,339 A * 10/1908 Grant ..... F16J 15/52 403/50

(Continued)

FOREIGN PATENT DOCUMENTS

DE 19858890 A1 * 6/2000 ..... F15B 15/084

*Primary Examiner* — Thomas E Lazo
*Assistant Examiner* — Matthew Wiblin
(74) *Attorney, Agent, or Firm* — Birch, Stewart, Kolasch & Birch, LLP

(57) ABSTRACT

The present invention addresses the technical problem of providing an actuator which is provided to prevent leakage through a rod in a hydraulic or pneumatic cylinder-type actuator, and in which an existing sealing member may be used, and in particular, a cable (wire) may be used as a rod for solving the problem regardless of surface roughness thereof. An actuator for solving the above-mentioned problem in accordance with the present invention includes: a cylinder having an inner portion filled with a fluid and a front cover for closing a front end portion thereof; a piston displaced inside the cylinder by the fluid; a sealing member having one end portion fixed to the piston and the other end portion fixed to the front cover; and an operation member inserted in the sealing member and having one end portion fixed to the piston and the other end portion extending out of the front cover. In the present invention, due to the above-mentioned configuration, the sealing of a fluid (f) is already achieved by the sealing member, and thus, the operation member serves a moving function if only slipping relative to the sealing member in the sealing member. Accordingly, a rod or a cable does not need to move while being in close contact with the sealing member. Therefore, as in conventional arts, the present invention has merits in that a remarkable improvement is achieved in terms of wear (Continued)

of the sealing member, and it is not necessary to smoothly and precisely process the rod and to smoothly and hardly coat the cable.

12 Claims, 10 Drawing Sheets

(51) Int. Cl.
*F15B 15/08* (2006.01)
*F15B 15/06* (2006.01)

(52) U.S. Cl.
CPC ..... *F15B 15/084* (2013.01); *F15B 15/088* (2013.01); *F15B 15/1428* (2013.01); *F15B 15/1452* (2013.01); *F15B 15/1461* (2013.01); *E02F 9/225* (2013.01); *E02F 9/2264* (2013.01)

(56) References Cited

U.S. PATENT DOCUMENTS 5,443,134 A * 8/1995 Gajek ..... B62L 1/14
188/2 D
6,988,440 B2 * 1/2006 Morr ..... F15B 15/06
92/13.7
2011/0062672 A1 * 3/2011 Baumann ..... F16J 15/52
277/510

* cited by examiner

[FIG.1]
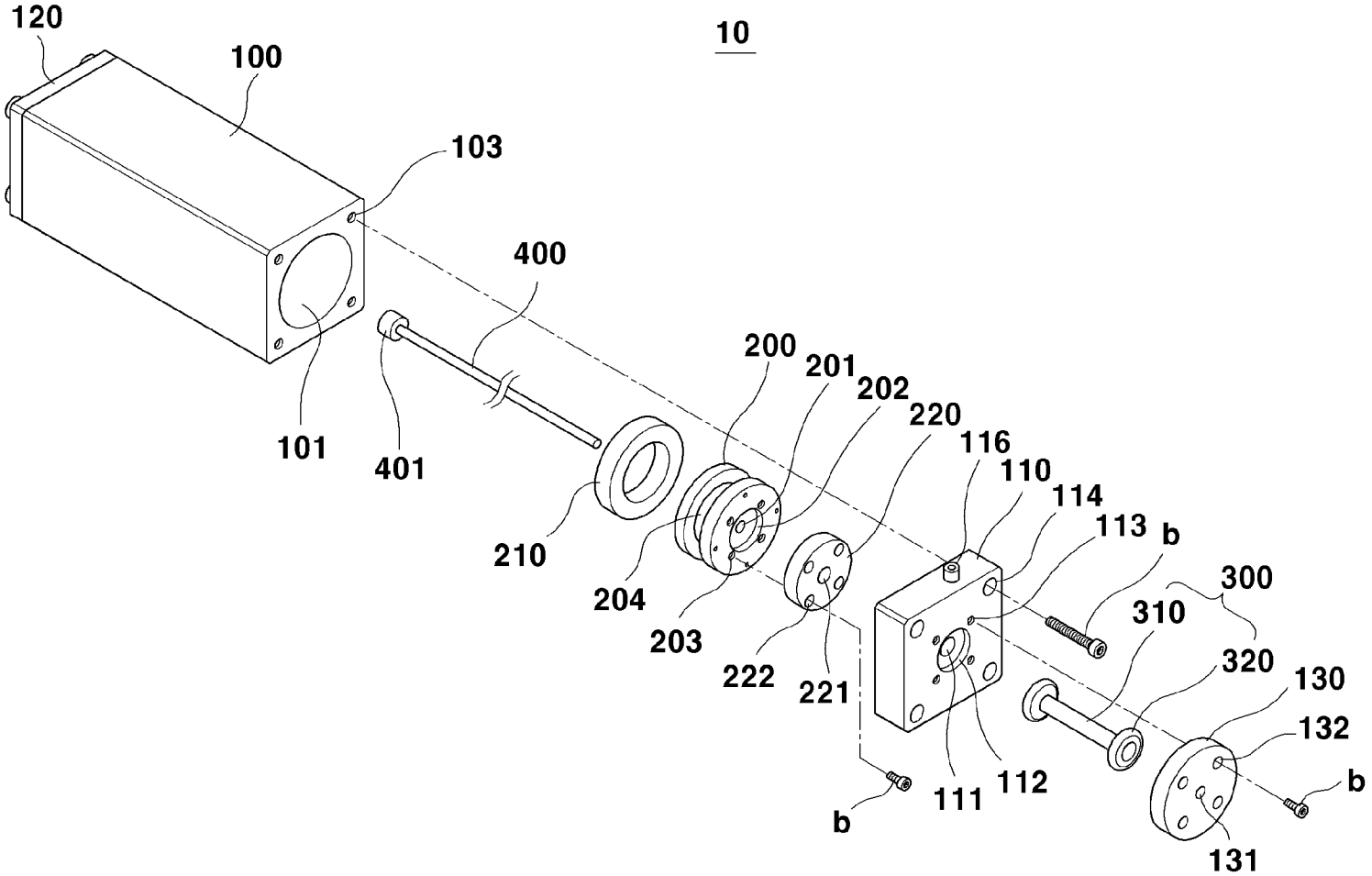

【FIG.2】
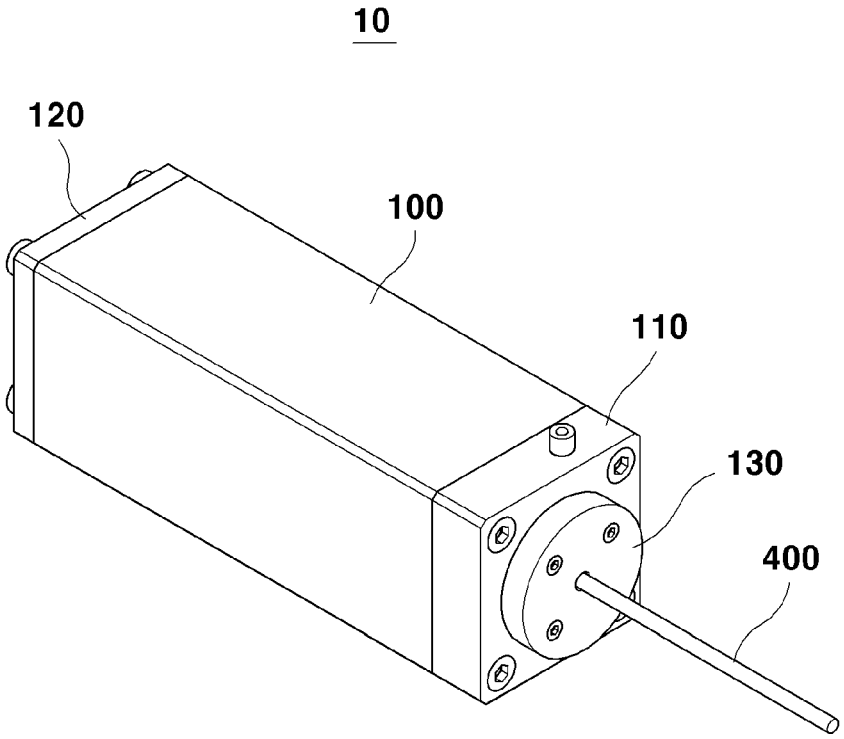
【FIG.3】
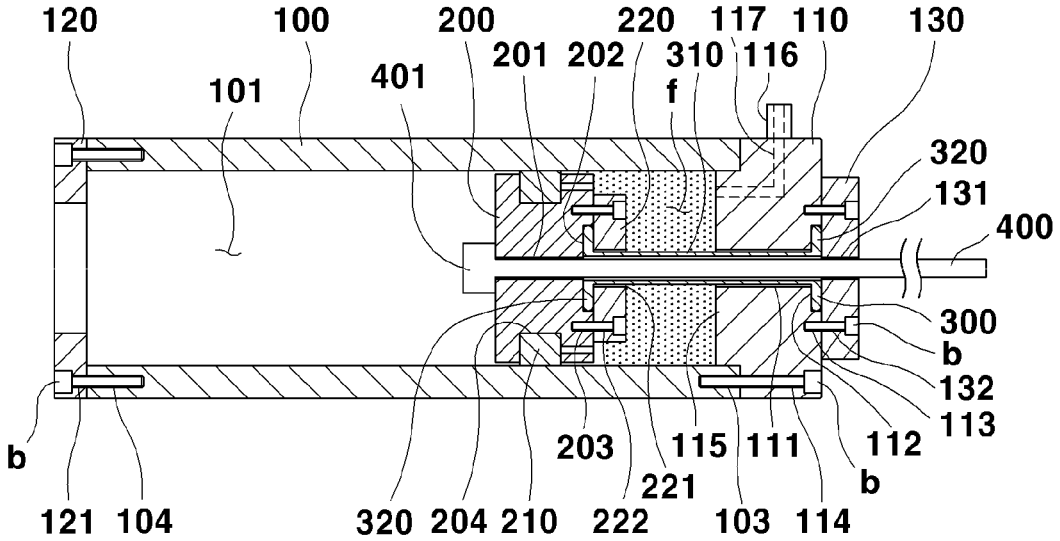

【FIG.4A】
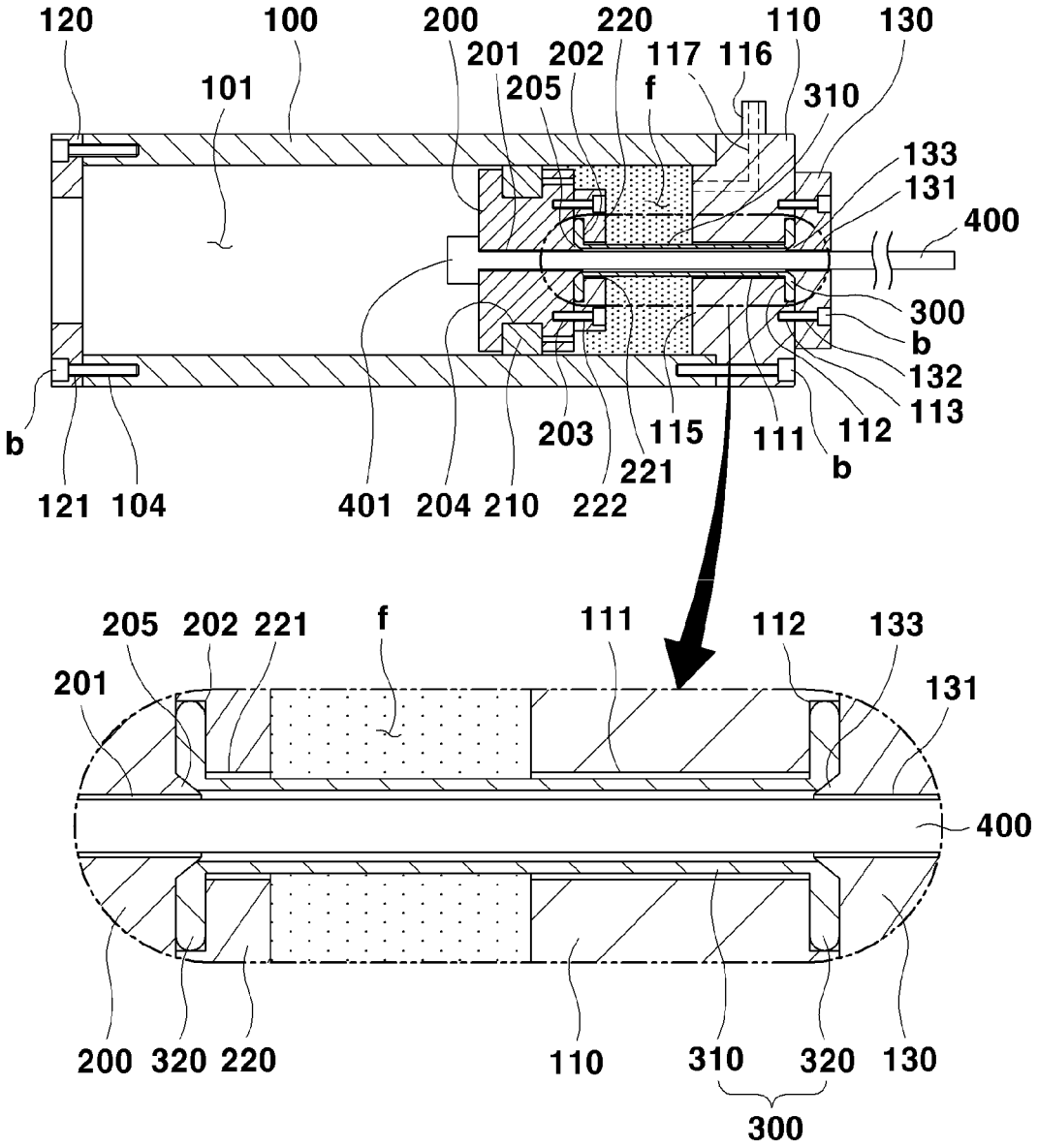

【FIG.4B】
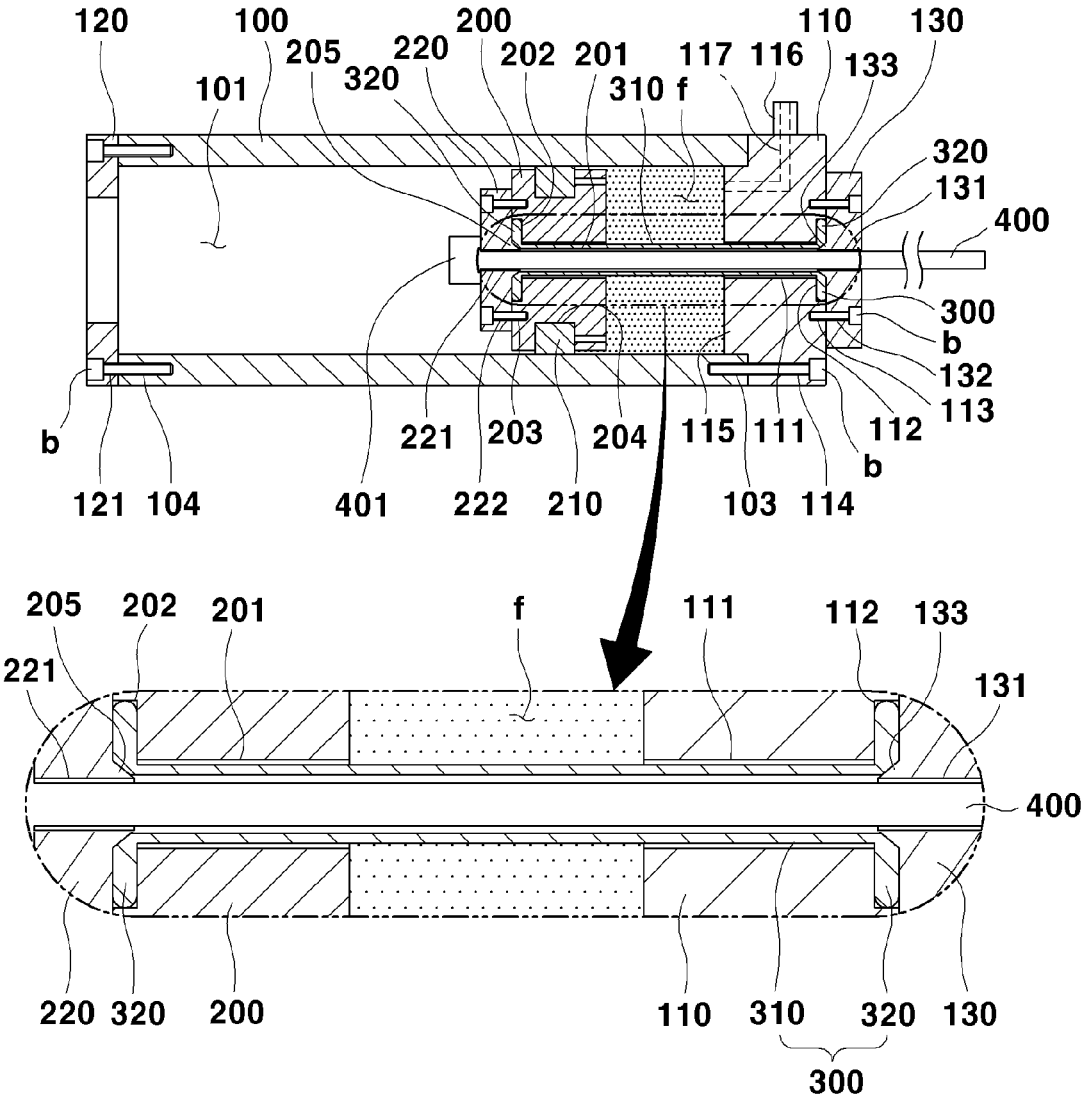

【FIG.5】
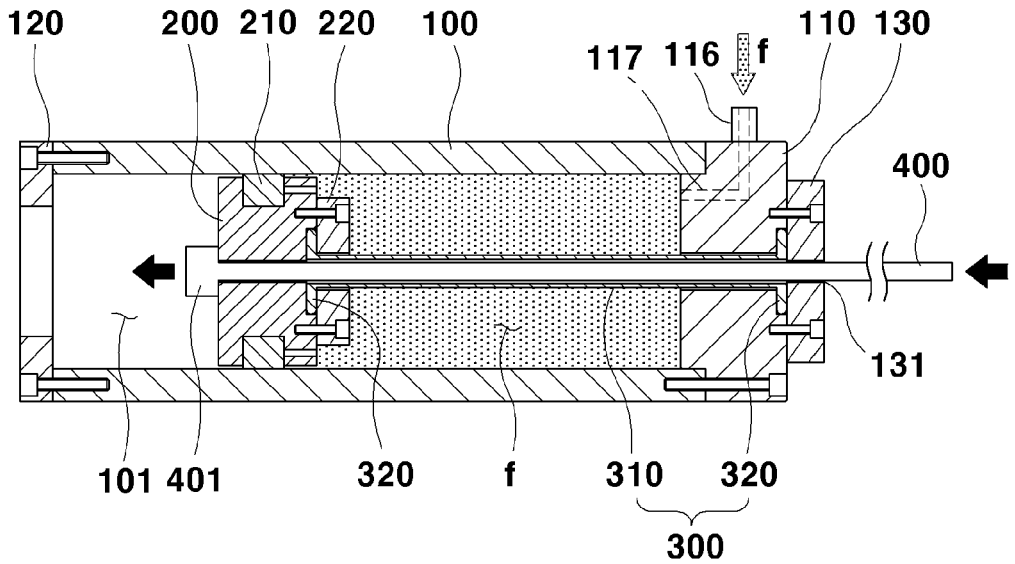
(a)
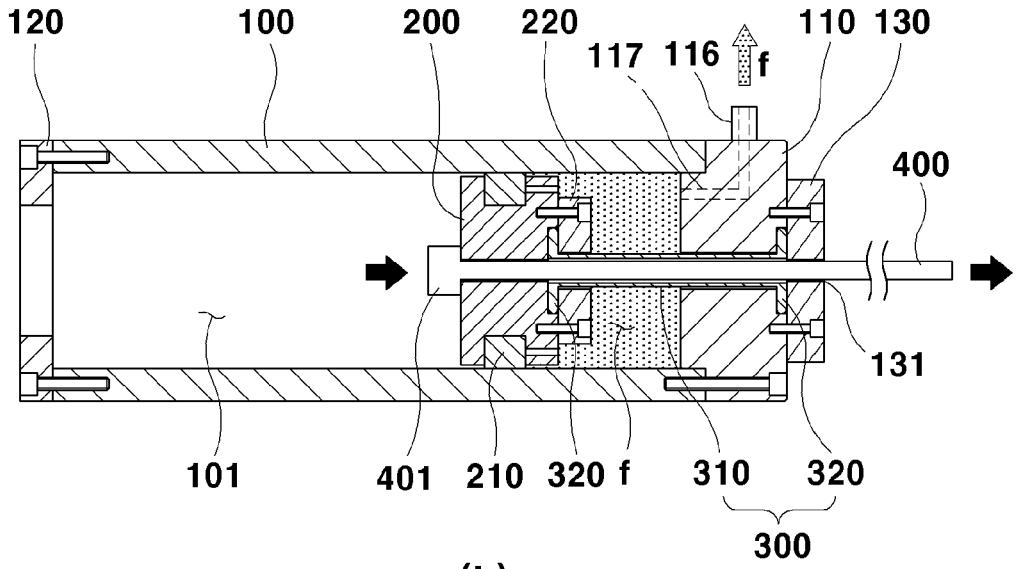
(b)

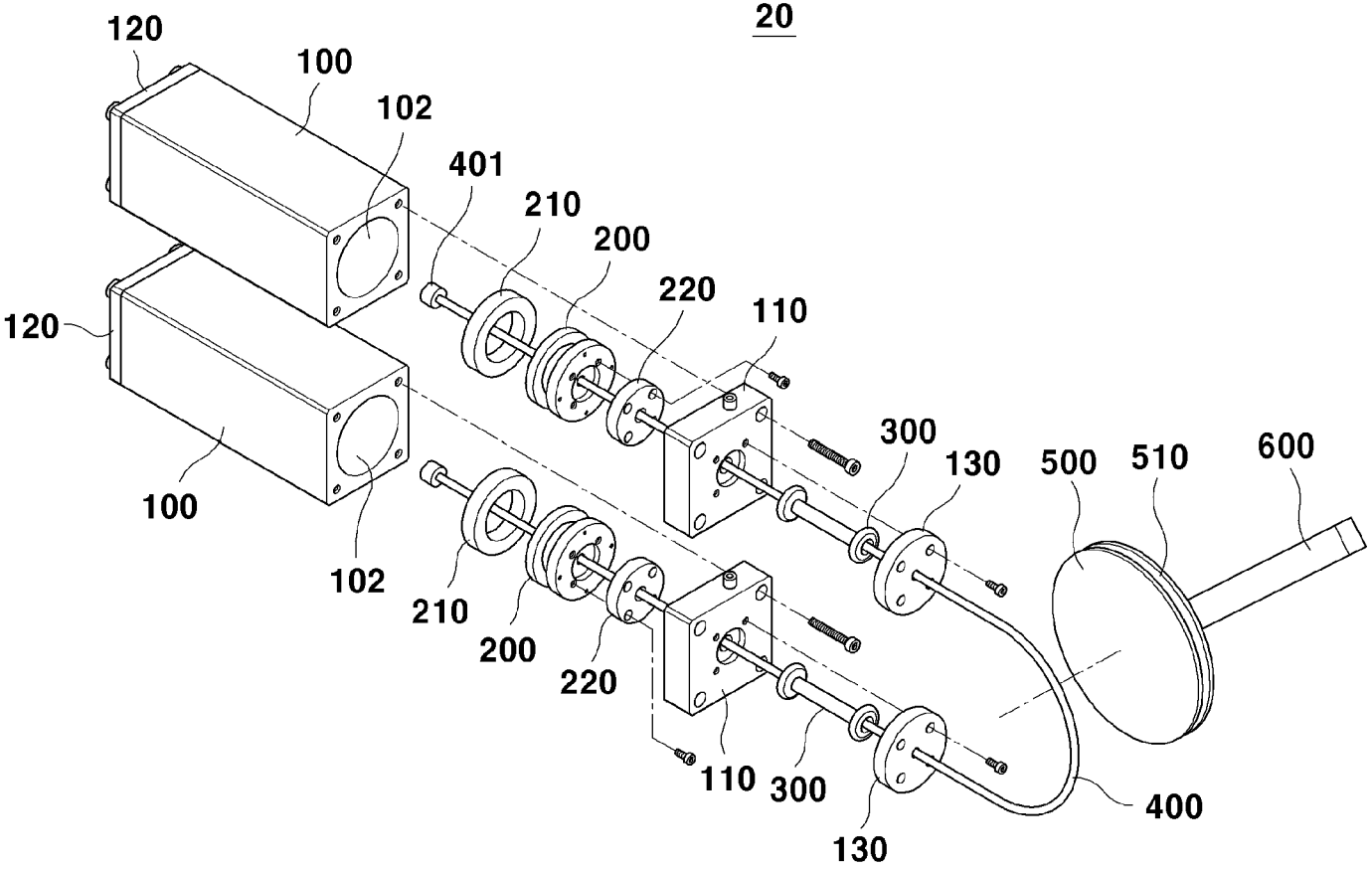
[FIG.6]

【FIG.7】
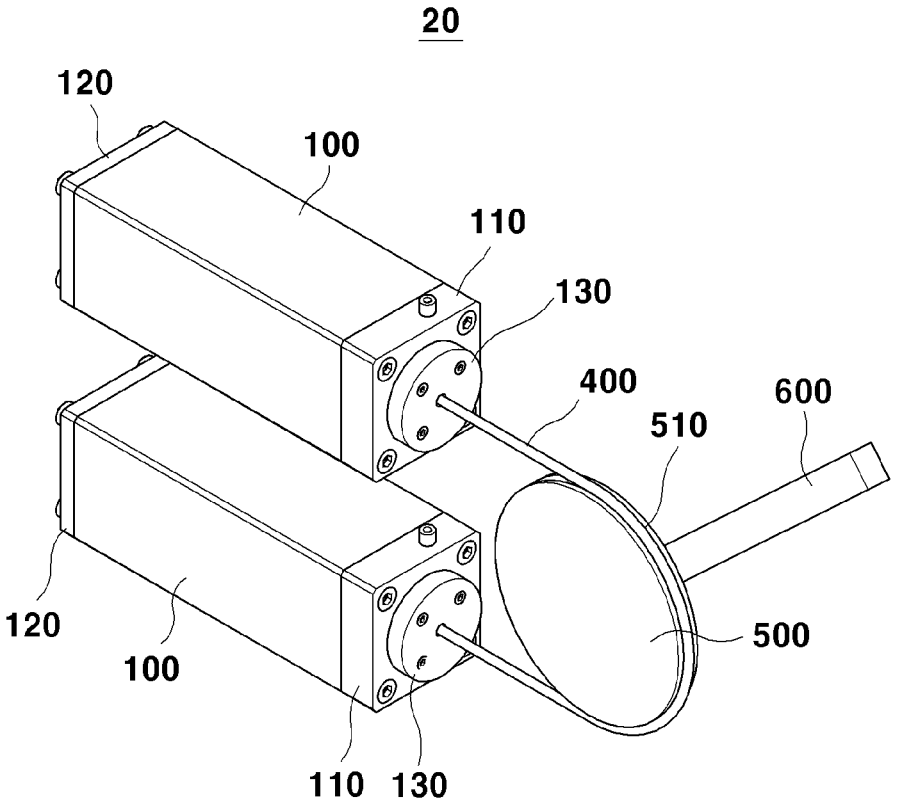

【FIG.8】
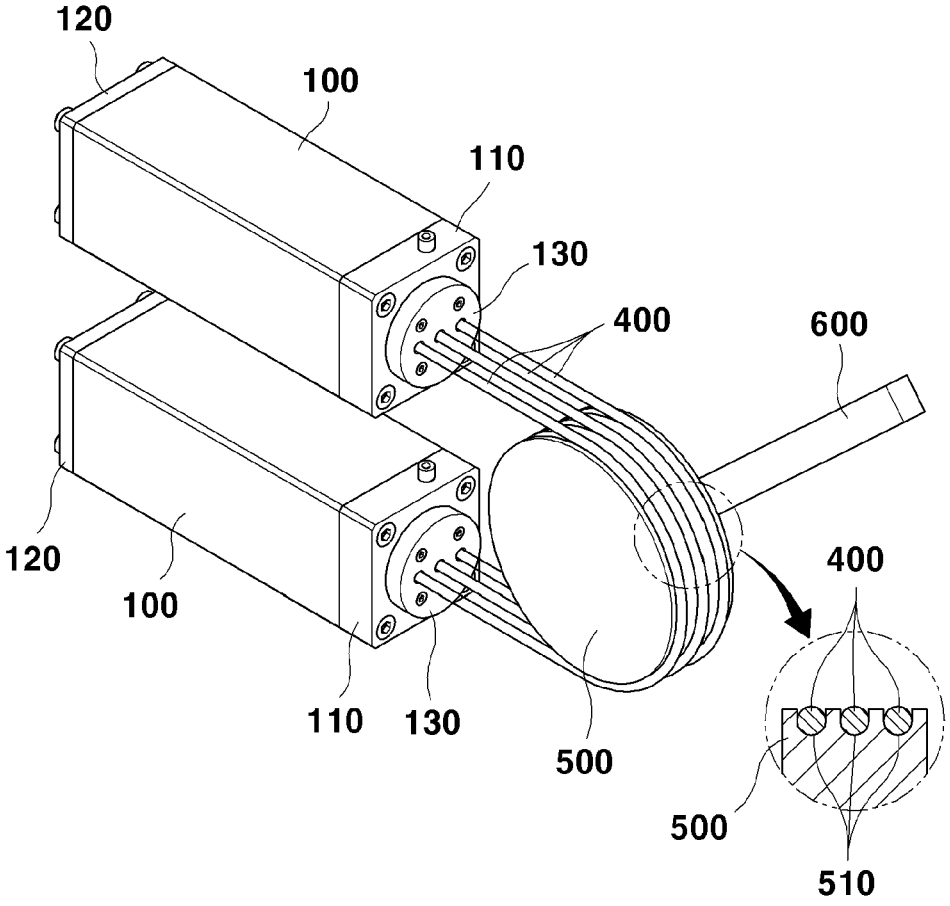

【FIG.9】
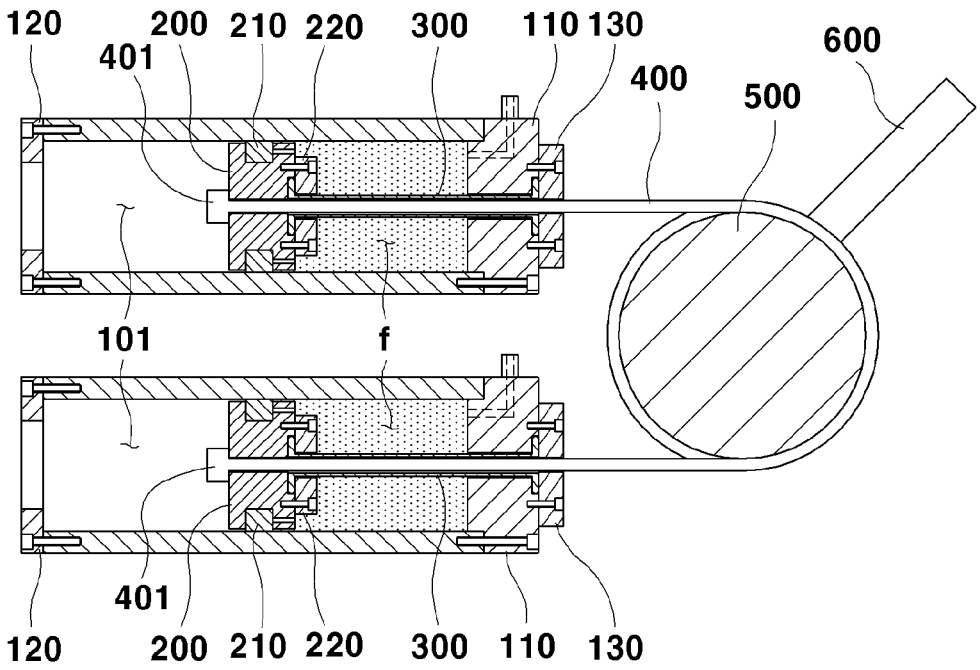
【FIG.10】
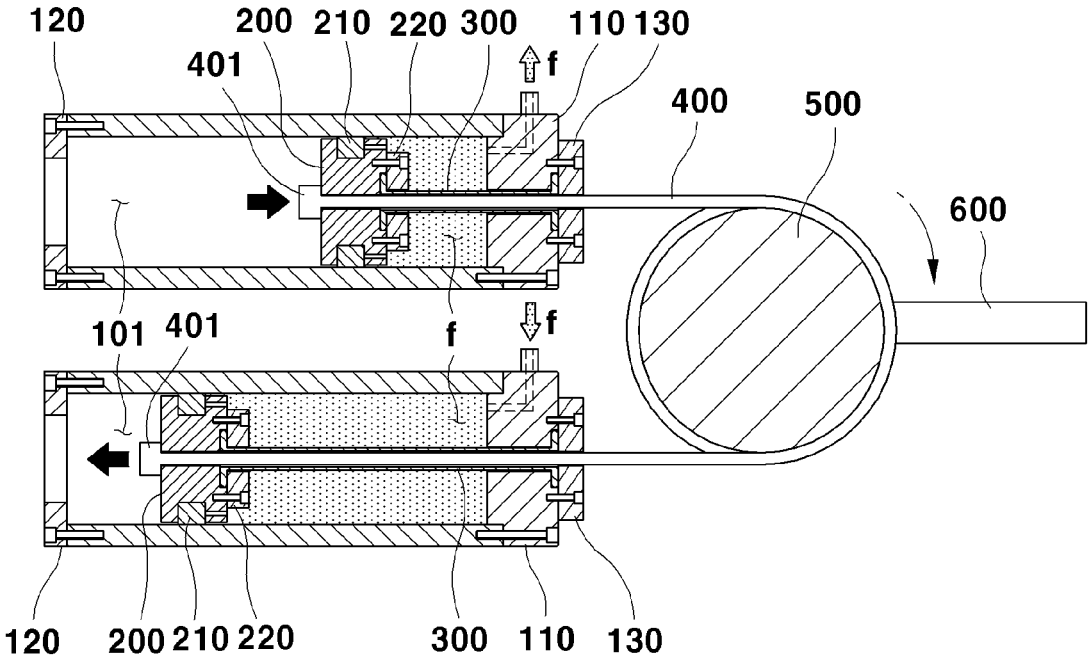

【FIG.11A】
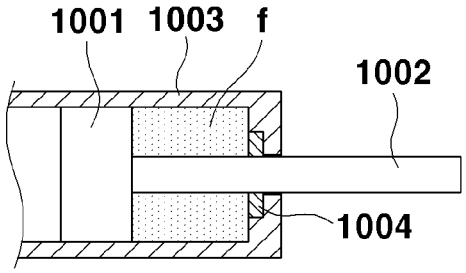
【FIG.11B】
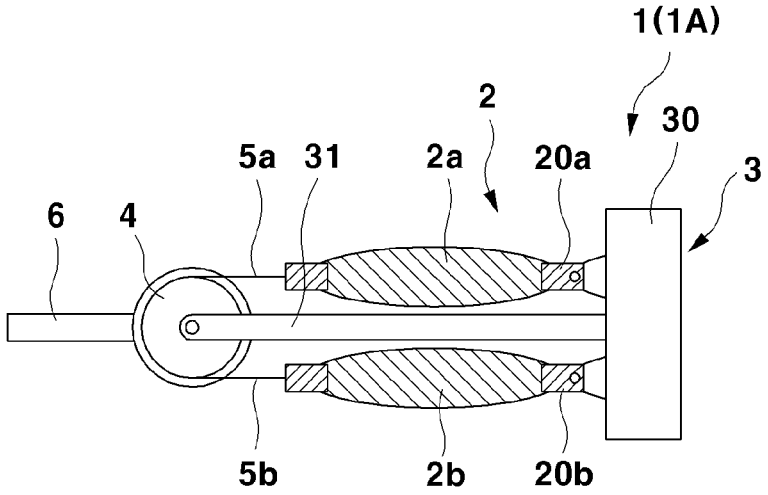
【FIG.11C】
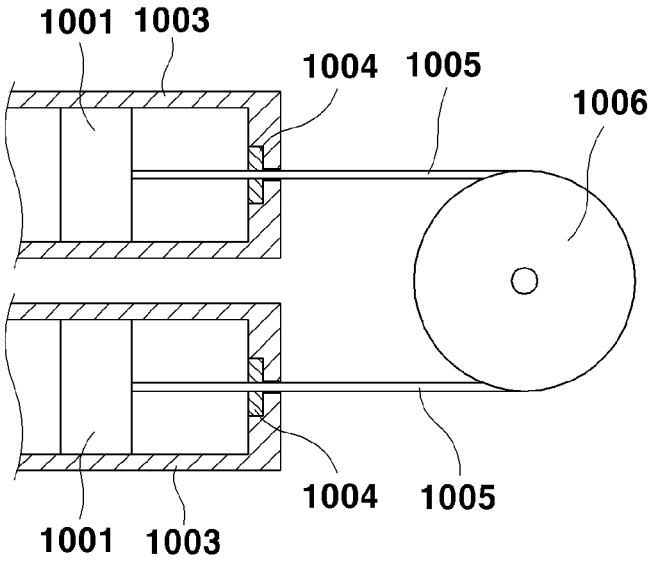

ACTUATOR

CROSS REFERENCE TO RELATED APPLICATIONS

This non-provisional application claims the benefit under 35 U.S.C. § 119(a) to Patent Application No. 10-2016-0167315, filed in the Republic of Korea on Dec. 9, 2016, which is hereby expressly incorporated by reference into the present application.

TECHNICAL FIELD

The present invention relates to an actuator, and more particularly, to a hydraulic or pneumatic actuator in which fluid leakage is prevented while an operation distance required for a sufficient rotational movement is ensured.

BACKGROUND ART

A rotational joint is configured by using a motor and a reducer or using a hydraulic or pneumatic actuator, and in this case, when a hydraulic pressure is used, a cylinder-type actuator is mainly used.

In the case of a cylinder-type actuator, when a hydraulic actuator is particularly used, there is a merit of having a large output to volume ratio which is advantageous when a great amount of force or a dynamic motion is required.

In a cylinder-type actuator, as illustrated in FIG. 11A, even when a rod 1002 of a piston 1001 reciprocates, a sealing member 1004 is installed with respect to the rod 1002 to seal the rod 1002 so that a fluid f filling the inside of a cylinder 1003 does not leak.

Since a surface portion of the rod 1002 reciprocates while being in continuous frictional contact with the sealing member 1004, the surface of the rod 1002 should be smoothly processed to reduce friction, and thus, processing costs increase.

In addition, when a rotary joint is configured from a cylinder-type actuator in an excavator or the like, an operation range (driving angle) is restricted, and there is a limitation in that a complicated link mechanism is required to solve this.

To solve such a limitation, a tendon actuator of a Mckibben muscle-type which uses a cable or the like is disclosed in Japanese Patent Application Laid-open Publication No. 2012-125847.

In such a method, as illustrated in FIG. 11B, two first and second artificial muscles 2*a* and 2*b* are installed in parallel on a main body part 3.

First and second wires 5*a* and 5*b* are respectively connected to one end portions of respective artificial muscles 2*a* and 2*b*, and air supply parts 20*a* and 20*b* for supplying compressed air are respectively provided on the other end portions.

The first and second wires 5*a* and 5*b* are wound around a pulley 4 and a link part 6 is installed on the pulley 4.

The tendon actuator 2 is configured such that when compressed air is alternately supplied to each of the first and second artificial muscles 2*a* and 2*b* through air supply parts 20*a* and 20*b*, the first and second wires 5*a* and 5*b* are moved to thereby rotate the pulley 4, and thus, the link part 6 performs a joint motion while rotating.

However, in the case of such a tendon-type actuator, there is a limitation in that elastic deformation amounts of the first and second artificial muscles 2*a* and 2*b* are not so large that a sufficient operation range of the actuator cannot be ensured.

To solve such a limitation, an actuator of WC BRANHAM Co. in which the rod 1002 is substituted by a cable 1005 in the configuration of the conventional hydraulic or pneumatic actuator illustrated in FIG. 11A.

As illustrated in FIG. 11C, also in such a method, a problem of preventing leakage of fluid f between a cable 1005 and a sealing member 1004 may occur. To solve this, the cable 1005 is used such that the surface thereof is coated for increasing durability and preventing fluid leakage.

However, also in this case, the cable 1005 and the sealing member 1004 should be maintained to be in close contact with each other to prevent fluid leakage, and when the number of movements of the cable 1005 is increased due to a long operation time or the like, the sealing member 1004 is worn due to friction, and thus fluid leakage occurs.

In addition, there is a limitation in that the coating applied to the surface of the cable 1005 is damaged due to the contact and friction with a pulley 1006 while being wound and loosened around the pulley 1006, and the sealing between the cable 1005 and the sealing member 1004 is not ensured, thereby causing fluid leakage.

DISCLOSURE OF THE INVENTION

Technical Problem

The present invention, as described above, addresses the technical problem of providing an actuator which can reliably operate without fluid leakage while ensuring required operational movements by elongating an operation distance of the actuator.

Technical Solution

An actuator for solving the above-mentioned limitations in accordance with an exemplary embodiment of the present invention, includes: a cylinder having an inner portion filled with a fluid and a front cover for closing a front end portion thereof; a piston displaced inside the cylinder by the fluid; a sealing member having one end portion fixed to the piston and the other end portion fixed to the front cover; and an operation member inserted in the sealing member and having one end portion fixed to the piston and the other end portion extending out of the front cover.

In an embodiment, the sealing member may include: a hollow part having a hollow inside; and fixed parts formed to have greater transverse widths than the hollow part, wherein one of the fixed parts may be fixed to the front cover, the other may be fixed to the piston, and the operation member may be inserted into the hollow part.

In an embodiment, the sealing member may be formed of an elastic material.

In an embodiment, one of the fixed parts may be fixed by a first fastening cover fastened to the front cover, and the other may be fixed by a second fastening cover fixed to the piston In an embodiment, either or both of the front cover and the first fastening cover may be provided therein with a first sealing member receiving groove for receiving the one of the fixed parts; either or both of the piston and the second fastening cover may be provided with a second sealing member receiving groove for receiving the other of the fixed parts; the first fastening cover may be fastened to the front cover so as to cover the first sealing member receiving groove, and the second fastening cover may be fastened to the piston so as to cover the second sealing member receiving groove.

In an embodiment, the first sealing member receiving groove may be formed on the front cover, and a first sealing member insertion hole for allowing the sealing member to pass therethrough may be formed around the first sealing member receiving groove.

In an embodiment, the first fastening cover is provided therein with a first operation member penetrating hole for inserting the operation member therethrough, and the piston is also provided with a second operation member penetrating hole for inserting the operation member therethrough.

In an embodiment, a first guide part may be formed around the first operation member penetrating hole of the first fastening cover, and may have an outer portion protruding so as to have a thickness which gradually decreases in the upward direction, and an inner portion thereof extending from the first operation member penetrating hole.

In an embodiment, the second sealing member receiving groove may be formed on the second fastening cover, and a second sealing member insertion hole for allowing the sealing member to pass therethrough may be formed around the second sealing member receiving groove.

In an embodiment, a second guide part may be formed around the second operation member penetrating hole of the second fastening cover, the outer portion of the second guide part may protrude so as to have a thickness which gradually decreases in the upward direction, and the second operation member penetrating hole may extend inside the second guide part.

In an embodiment, the front cover may be integrally formed with the cylinder.

In an embodiment, the hollow member and the operation member inserted through the hollow member may be provided in plurality.

In an embodiment, the operation member may be composed of a rod or cable.

An actuator apparatus in accordance with an exemplary embodiment of the present invention includes: a pair of actuators, the actuators each comprising: a cylinder having an inner portion filled with a fluid and a front cover for closing a front end portion thereof; a piston displaced inside the cylinder by the fluid; and a sealing member having one end portion fixed to the piston and the other end portion fixed to the front cover; the actuator apparatus comprising a flexible operation member having: one end portion inserted through the sealing and fixed to the piston; and the other end portion extending out of the front cover, wound around a pulley, and then inserted through the sealing member of another actuator and fixed to a piston.

In an embodiment, the sealing member may include: a hollow part having a hollow inside; and fixed parts formed to have greater transverse widths than the hollow part, wherein one of the fixed parts may be fixed to the front cover, the other may be fixed to the piston.

In an embodiment, the sealing member may be formed of an elastic material.

In an embodiment, one of the fixed parts may be fixed by a first fastening cover fastened to the front cover, and the other may be fixed by a second fastening cover fixed to the piston.

In an embodiment, either or both of the front cover and the first fastening cover may be provided therein with a first sealing member receiving groove for receiving the one of the fixed parts; either or both of the piston and the second fastening cover may be provided with a second sealing member receiving groove for receiving the other of the fixed parts; the first fastening cover may be fastened to the front cover so as to cover the first sealing member receiving groove, and the second fastening cover may be fastened to the piston so as to cover the second sealing member receiving groove.

In an embodiment, the first fastening cover may be provided therein with a first operation member penetrating hole for allowing the operation member to pass therethrough, and the piston may also be provided therein with a second operation member penetrating hole for allowing the operation member to pass therethrough.

In an embodiment, the first sealing member receiving groove may be formed on the front cover, and a first sealing member insertion hole for allowing the sealing member to pass therethrough may be formed around the first sealing member receiving groove.

In an embodiment, a first guide part may be formed around the first operation member penetrating hole of the first fastening cover, and may have an outer portion protruding so as to have a thickness which gradually decreases in the upward direction, and an inner portion extending from the first operation member penetrating hole.

In an embodiment, the second sealing member receiving groove may be formed on the second fastening cover, and a second sealing member insertion hole for allowing the sealing member to pass therethrough may be formed around the second sealing member receiving groove.

In an embodiment, a second guide part may be formed around the second operation member penetrating hole of the second fastening cover, the outer portion of the second guide part may protrude so as to have a thickness which gradually decreases in the upward direction, and the second operation member penetrating groove may extend inside the second guide part.

In an embodiment, the front cover may be integrally formed with the cylinder.

In an embodiment, the hollow member and the operation member inserted through the hollow member may be provided in plurality.

In an embodiment, the operation member may be configured form a cable.

Advantageous Effects

In an actuator in accordance with an exemplary embodiment of the present invention, due to the above-mentioned configuration, the sealing of a fluid f is already achieved by the sealing member, and thus, the operation member only need to move in the sealing member. Therefore, the leakage of fluid or air is completely blocked and there are merits in terms of operation reliability, energy efficiency, and pollution of products.

In addition, the operation member does not need to move while being in close contact with the sealing member, and thus, there is a merit in that a remarkable improvement may be achieved in terms of wear of the sealing member compared to conventional arts in which the operation member moves while being in close contact with the sealing member.

In particular, in the present invention, when the actuator operates, there is a difference in displacements of the sealing member and the operation member, but the two members basically move in the same direction, and therefore, there is an effect in that relative friction between the two members is reduced.

Accordingly, only the operation member moves while the sealing member is fixed, and therefore, compared to conventional arts in which relative friction increases, a further improved effect may be achieved in terms of wear of the sealing member.

In addition, a step of coating an operation member to prevent wear of the sealing member to thereby prevent fluid leakage as in conventional art is not required, and thus, there is an effect of reducing manufacturing process and saving costs.

An actuator in accordance with an exemplary embodiment of the present invention adopts a cable instead of a rod in a conventional art using the rod, and thus, there is a merit compared to conventional arts in which a joint motion is achieved by using a conventional rod-type actuator.

In particular, a rod is used as the operation member in the present invention, the surface of the rod may be less smoothly and less precisely processed compared to conventional arts in which a rod is used, and thus, there is an effect of saving machining costs.

An actuator in accordance with an exemplary embodiment of the present invention may be provided in a hydraulic actuator form actuator while basically using an operation member, and thus, there is an effect of increasing an operation distance compared to conventional arts in which a Mckibben muscle or the like having a short elastic length.

Meanwhile, in an actuator in accordance with an exemplary embodiment of the present invention, an operation member does not need to be smoothly and hardly coated as in conventional arts, so that the minimum curvature of radius of the operation member may be reduced, and accordingly, the diameter of a driving pulley may be reduced, thus having an effect of reducing overall size of a joint apparatus.

BRIEF DESCRIPTION OF THE DRAWINGS

FIG. 1 is an exploded perspective view of an actuator in accordance with an exemplary embodiment of the present invention.

FIG. 2 is a view illustrating a state in which an actuator in accordance with an exemplary embodiment of the present invention is assembled.

FIG. 3 is a cross-sectional view of an actuator in accordance with an exemplary embodiment of the present invention.

FIGS. 4A and 4B are views illustrating an embodiment of a second guide part in an actuator in accordance with an exemplary embodiment of the present invention.

FIG. 5 is a view illustrating an operating state of an actuator in accordance with an exemplary embodiment of the present invention.

FIG. 6 is an exploded perspective view of an actuator apparatus in accordance with another exemplary embodiment of the present invention.

FIG. 7 is a view illustrating a state in which an actuator apparatus in accordance with another exemplary embodiment of the present invention is assembled.

FIG. 8 is a view illustrating a case in which a plurality of cables are provided in an actuator apparatus in accordance with another exemplary embodiment of the present invention.

FIG. 9 is a cross-sectional view of an actuator apparatus in accordance with another exemplary embodiment of the present invention.

FIG. 10 is a view illustrating an operating state of an actuator apparatus in accordance with another exemplary embodiment of the present invention is coupled.

FIGS. 11A, 11B, and 11C are views illustrating conventional arts.

MODE FOR CARRYING OUT THE INVENTION

Hereinafter a preferred example of a hydraulic actuator in accordance with the present invention will be described in more detail with reference to the accompanying drawings.

In all drawings herein, elements having the same functions will be referred to as the same reference numerals and repeated description thereof will not be provided. In addition, it is clarified that terms described herein is defined in consideration of functions thereof in the present invention and should be interpreted in an inherent commonly used meaning.

FIG. 1 is an exploded perspective view of an actuator in accordance with an exemplary embodiment of the present invention. FIG. 2 is a view illustrating a state in which an actuator in accordance with an exemplary embodiment of the present invention is assembled. FIG. 3 is a cross-sectional view of an actuator in accordance with an exemplary embodiment of the present invention.

An actuator 10 according to an embodiment of the present invention includes: a cylinder 100; a piston 200 installed in the cylinder 100, a sealing member 300 connected between the piston 200 and the cylinder 100; and an operation member 400 inserted into the sealing member 300.

The cylinder 100 has a known configuration, and in this embodiment, has a rectangular outer shape, is provided with a cylindrical hollow part 101 passing through the inside thereof, and has a shape with opened front and rear sides.

The hollow part 101 inside the cylinder 100 between a front cover 110 and the piston 200 is filled with a working fluid f.

A stepped portion 115 of the front cover 110 is inserted into the hollow part 101 in a front end portion of the cylinder 100.

Fastening holes 103 for fastening the front cover 110 are formed in a front end surface of the cylinder 100.

A first sealing member inserting hole 111, which passes through the front cover 110 in the central axis direction and has a shape and a size in which the sealing member 300 can be inserted, is formed in the central portion of the front cover 110.

A first sealing member receiving groove 112 for receiving a fixing part 320 of the sealing member 300 is formed around the first sealing member inserting hole 111.

The first sealing member receiving groove 112 is formed to have a shape and a size which correspond to an end portion of the fixing part 320 of the sealing member 300 so as to receive the end portion, and first fastening holes 113 for fastening the first fastening cover 130 are formed around the first sealing member receiving groove 112.

In this embodiment, the first sealing member receiving groove 112 is provided on, but not limited thereto, the front surface of the front cover 110, and may also be formed in the rear surface of the first fastening cover 130 or may also be formed both in the front surface of the front cover 110 and in the rear surface of the first fastening cover 130.

Second fastening holes 114 for fastening the front cover 111 to the cylinder 100 are formed in a peripheral portion of the front cover 110.

The stepped portion 115 having a shape and a size, which correspond to the hollow part 101 so as to be inserted into the hollow part 101 in the front end portion of the cylinder 100, is formed in the rear end portion of the front cover 110.

A port 116 for introducing/discharging the working fluid f into/out of the cylinder 100 is provided on an upper portion of the front cover 110, and the port 116 is configured to communicate with the hollow part 101 through a flow passage 117 formed inside the front cover 110.

A rear cover 120 is fastened to the rear side of the cylinder 100 such that fastening members b pass through fastening holes 121 formed in a periphery of the rear cover 120 and are inserted into rear side fastening holes 104 formed on the rear end portion of the cylinder 100.

In this embodiment, the front cover 110 and the rear cover 120 are provided separately from the cylinder 100, but either or both thereof may be integrally provided with the cylinder 100.

The first fastening cover 130 having a flat-plate shape is fastened on the front surface of the front cover 110.

The first fastening cover 130 is formed to have a greater size than the first sealing member receiving groove 112 so as to entirely cover the first sealing member receiving groove 112.

A first operation member penetrating hole 131, which has a shape corresponding to the operation member 400 such that the operation member can pass therethrough, is formed on the central portion of the first fastening cover 130, and cover fastening holes 132 are formed around the first operation member penetrating hole 131.

In another embodiment of the present invention, as illustrated in FIG. 3B, a first guide part 133 may be further provided around the first operation member penetrating hole 131 on the rear surface of the first fastening cover 130.

The outer portion of the first guide part 133 is formed to protrude so as to have a thickness which gradually decreases in the upward direction, and the inner portion of the first guide part 133 is formed to extend from the first operation member penetrating hole 131.

This embodiment relates to the case in which the first fastening cover 130 is fastened onto the front surface of the front cover 110, but embodiments are not limited thereto, and the first fastening cover 130 may be provided on the rear surface of the front cover 110.

The piston 200 has an approximately circular plate shape, and a second operation member penetrating hole 201 is formed in the piston 200 such that the operation member 400 passes and is inserted therethrough.

A second sealing member receiving groove 202 which has a shape corresponding to the other end portion of the sealing member 300 to receive the other portion is formed around the second operation member penetrating hole 201 in the front end portion of the piston 200.

Third fastening holes 203 for fastening the second fastening cover 220 are formed around the second sealing member receiving groove 202.

Meanwhile, a concave groove 204 is formed in a middle portion of the circumferential surface of the piston 200, and a sealing 210 is inserted into the concave groove 204.

FIGS. 4A and 4B are views illustrating an embodiment of a second guide in an actuator in accordance with an exemplary embodiment of the present invention.

A second guide part 205 may be formed around the second operation member penetrating hole 201 on the front surface of the piston 200.

Like the first guide part 133, the second guide part 205 is configured such that an outer portion thereof protrudes with a thickness which gradually decreases in an upward direction and an inner portion thereof extends from the second operation member penetrating hole 201.

In the present invention, either or both of the first guide part 133 and the second guide part 205 may be provided.

A second fastening cover 220 is fastened onto the front surface of the piston 200.

In this embodiment, the second fastening cover 220 has an outer shape which is the same as or smaller than that of the piston 200, is formed in a flat-plate shape, and is provided therein with a second sealing member insertion hole 221 having a shape and a size which correspond to the sealing member 300 such that the sealing member 300 passes and is inserted therethrough.

In this embodiment, the second sealing member receiving groove 202 is formed in the front surface of the piston 200, but embodiments are not limited thereto, and as illustrated in FIG. 4A, the second sealing member receiving groove 202 may be formed in the rear surface of the second fastening cover 210 or may also be formed both in the front surface of the piston 200 and the rear surface of the second fastening cover 210.

Fastening member penetrating holes 222 are formed around the second sealing member insertion hole 221 in the second fastening cover 220.

In another embodiment of the present invention, as illustrated in FIG. 4B, the second fastening cover 220 is fastened not onto the front surface but onto the rear surface of the piston 200.

In such a case, the second sealing member receiving groove 202 is formed in the rear end portion of the piston 200, and the second guide part 205 is formed not in the front side of the piston 200 but in the front side of the second fastening cover 220 such that the outer portion thereof have a thickness which gradually decreases in the upward direction, and the inner portion thereof extends from the second operation member penetrating hole 205.

In this embodiment, rubber is used as the material for the sealing member 300, but other materials may also be used as long as the materials have elasticity.

The sealing members 300 includes: a hollow part 310 having a hollow shape such that the operation member 400 can be inserted therethrough; and fixing parts 320 which are formed on both end portions of the hollow part 310 and have greater width than the hollow part 310.

The traverse width of the hollow part 310 is favorably provided to be greater than that of the operation member 400 so as not to directly contact the operation member 400 while receiving the operation member 400.

More specifically, the traverse width of the hollow part 310 decreases because when the sealing member 300 is extended, the hollow part 310 is contracted, and considering this, the traverse width of the hollow part 310 may be determined such that the hollow part 310 and the operation member 400 are not brought into too close contact with each other.

The fixing part 320 is provided to have a greater traverse width than the hollow part 310, thus functioning to fix the sealing member 300.

In this embodiment, a middle portion 310 and end portions 320 are formed to have circular shapes when viewed in a side view, but embodiments are not limited thereto.

That is, the hollow part 310 is only need to be provided such that the operation member 400 may be inserted thereinto, and the fixing parts 320 may also be formed in other shapes, as long as the shape has greater traverse width than the hollow part 310 such that the sealing member 300 can be fixed.

The operation member 400 is a member for transferring a force due to a movement of the piston 200, and a rigid rod, a flexible cable, or the like may be used as the operation member 400.

When a cable is used, several strands of steel wires having small diameters may be twisted and used so as to achieve free movement (flexibility), and improved durability and strength, or other type materials, such as fiber materials like carbon braiding may also be used.

One end portion of the operation member 400 is fixed to an end portion of the piston 200 by an operation member fixing part 401 and the other end portion is connected to another apparatus.

The operation member fixing part 401 may be provided to have a knot so that the operation member is not detached from the piston 200, or may also be provided in a screw shape for adjusting the tension of the operation member through rotation.

On end portion of the operation member 400 passes through the first operation member penetrating hole 131 of the first fastening cover 130, is inserted into the sealing member 300, is then via the second operation member penetrating hole 201 of the piston 200, and is finally fixed to the operation member fixing part 401.

In this embodiment, when the actuator 10 is operated, the operation member 400 slips and thereby moves on the inner surface of the sealing member 300, and therefore, the friction therebetween are basically not large. However, it is also possible to reduce the friction between the sealing member 300 and the operation member 400 by applying a lubricant, such as grease, inside the sealing member 300 if necessary.

Hereinafter the function of the actuator provided as described above will be described.

FIG. 5 is a view illustrating an operating state of an actuator in accordance with an exemplary embodiment of the present invention.

First, when a fluid f is supplied to a port 116 to operate an actuator 10, a piston 200 moves rearward (to the left in FIG. 5A), a pulling force is generated in the operation member 400, and thus, the operation member also moves to the left.

In addition, when the fluid is returned through a port 116, the piston 200 moves forward (to the right in FIG. 5B) again, and thus, while moving to the right, the operation member 400 functions as an actuator.

In this case, both fixing parts 320 of a sealing member 300 are respectively fixed so as to be sealed by first and second fastening covers 130 and 220, and a hollow part 310 is contracted and extended while maintaining a sealed state in the fluid.

As such, in the present invention, the sealing of the fluid f is already achieved by the sealing member 300, and thus, the operation member 400 serves a moving function if only slipping in the sealing member relative to the sealing member 300.

Accordingly, since the operation member 400 no longer needs to move while being in close contact with the sealing member 300, the operation member 400 shows remarkable improvement in terms of wear of the sealing member compared to a case in which the operation member moves while being in close contact with the sealing member as in conventional arts.

Particularly, in the present invention, when the actuator 10 operates, although there is a difference in displacements between the sealing member 300 and the operation member 400, the sealing member 300 and the operation member 400 move basically the same direction and thus serve a function to decrease the friction therebetween.

Accordingly, only the operation member moves while the sealing member is fixed, and therefore, compared to conventional arts in which relative friction increases, a further improved effect may be achieved in terms of wear of the sealing member.

In addition, a step of coating a cable to prevent wear of the sealing member to thereby prevent fluid leakage as in conventional arts is not required, and thus, there is an effect of reducing manufacturing processes and saving costs.

Meanwhile, in the present invention, when a first guide part 133 is installed on the rear surface of a first fastening cover 130, the first guide part 133 functions to separate the operation member 400 from the sealing member 300 by a certain distance in the sealing member 300.

In addition, when the first guide 133 is not present, while the first fastening cover 130 is fastened to the front cover 110, the rear surface of the first fastening cover 130 presses the fixing part 320 of the sealing member 300, and in this case, there may be a case in which a side surface of the fixing part 320 is deformed inward and contacts the operation member 400 according to circumstances.

When such a state is continued, overall sealing may have a problem while the fixing parts 320 of the sealing member 300 are worn due to the contact with the operation member 400. The first guide part 133 functions to prevent occurrence of such a problem.

Furthermore, when the sealing member 300 is extended, the fixing parts 320 on both sides thereof tend to be detached from the first sealing member receiving groove 112, and at this point, the first guide part 133 functions to prevent the detachment of the fixing parts 320.

The above-mentioned function and effects are similarly problematic on the side of the piston 200. The same function may be achieved by providing a second guide part 205 also on the side of the piston 200. In particular, the function of separating the operation member 400 from the sealing member 400 may be more advantageous when the guide parts are provided on both end portions of the sealing member 300.

Next, another exemplary embodiment of the present invention will be described.

FIG. 6 is an exploded perspective view of an actuator apparatus in accordance with another exemplary embodiment of the present invention. FIG. 7 is a view illustrating a state in which an actuator apparatus in accordance with another exemplary embodiment of the present invention is assembled. FIG. 8 is a view illustrating a case in which a plurality of operation members are provided in an actuator apparatus in accordance with another exemplary embodiment of the present invention. FIG. 9 is a cross-sectional view of an actuator apparatus in accordance with another exemplary embodiment of the present invention.

The above-mentioned embodiments relate to cases in which one actuator 10 is used, but another embodiment relates to an actuator apparatus, in which one pair of actuators 10 are connected by using a pulley 500, and thus, a joint rotating apparatus or the like is formed.

An actuator apparatus 20 according to another embodiment of the present invention includes: a pair of actuators 10, a pulley 500 connected with operating members 400 of the actuators 10, and a link part 600 connected to the pulley 500.

The pair of actuators 10 are provided to be the same, but while an operating member 400 is shared, one end portion of the operating member 400 is fixed to a piston 200 of one actuator and wound around the pulley 500, and the other end portion of the operating member 400 wound around the pulley 500 is fixed to a piston 200 of the other actuator.

In the case of the actuator apparatus 20, since the operation member 400 should be wound around the pulley 500, flexible cables which can be curved are used rather than a rigid rod.

In the present invention, when a great amount of force is required to drive the actuator, as illustrated in FIG. 8, a plurality of hollow members 300 and a plurality of operation members 400 inserted into the hollow members 300 may be provided.

In such a case, pulley grooves 501 formed on the outer circumferential surface of the pulley 500 are also provided in plurality.

That is, the actuator 10 is basically configured to exert a force such that one hollow member 300 and one operation member 400 are coupled on the central portion of the piston 200, but it is also possible to achieve a great amount of force and improved durability by providing two or more hollow members 300 and operation members 400 at intervals in the traverse direction of the piston 200.

Hereinafter the function of the actuator apparatus provided as described above will be described.

FIG. 10 is a view illustrating an operating state of an actuator apparatus in accordance with another exemplary embodiment of the present invention.

In this embodiment, the function of an actuator 10 is the same as that of the above-mentioned actuator.

However, in the actuator apparatus 20 of this embodiment, a fluid is supplied to one actuator 10, and simultaneously, a fluid is returned in the other actuator 10, and thus, an operation member 400 moves in one direction.

A pulley 500 rotates due to the one directional rotation of the operation member 400, and accordingly, a link part 600 fixed to the pulley 500 performs a joint motion. Such an actuator apparatus is suitable to implement various rotational motions such as joint motions of robots.

The actuator apparatus 20 in accordance with an exemplary embodiment of the present invention has a merit compared to conventional arts in which a rod is used to provide a joint apparatus in that a required operation range (operation angle) can be sufficiently achieved while the apparatus is simplified without a complicated link mechanism.

In addition, the actuator apparatus 20 in accordance with an exemplary embodiment of the present invention is provided in a form of a hydraulic actuator while basically using an operation member, and thus functions to increase the operation distance compared to conventional arts in which a Mckibben muscle or the like that has a short elastic length is used.

The present invention described so far should not be construed as limited to the above-mentioned examples and accompanying drawings. Those skilled in the art belong to the present invention could obviously substitute, modify, and change the present invention into other equivalent examples without departing from the technical concept of the present invention.

The invention claimed is:

1. An actuator comprising:

a cylinder having an inner portion filled with a fluid and a front cover for closing a front end portion thereof;

a piston displaced inside the cylinder by the fluid;

a sealing member having a first end portion fixed to the piston and a second end portion fixed to the front cover; and an operation member inserted through the sealing member and having a first end portion fixed to the piston and a second end portion extending out of the front cover, wherein the sealing member comprises:

a hollow part having a hollow inside; and fixed parts formed to have greater transverse widths than the hollow part, wherein a first fixed part of the fixed parts is fixed to the front cover, a second fixed part of the fixed parts is fixed to the piston, and the operation member is inserted through the hollow part, wherein the first fixed part is fixed by a first fastening cover fastened to the front cover, wherein the second fixed part is fixed by a second fastening cover fixed to the piston, wherein either or both of the front cover and the first fastening cover is provided therein with a first sealing member receiving groove for receiving the first fixed part, wherein either or both of the piston and the second fastening cover is provided with a second sealing member receiving groove for receiving the second fixed part, wherein the first fastening cover is fastened to the front cover so as to cover the first sealing member receiving groove, wherein the second fastening cover is fastened to the piston so as to cover the second sealing member receiving groove, wherein the first fastening cover is provided therein with a first operation member penetrating hole for inserting the operation member therethrough, and wherein the piston is provided therein with a second operation member penetrating hole for inserting the operation member therethrough.

2. The actuator of claim 1, wherein the sealing member is formed of an elastic material.

3. The actuator apparatus of claim 1, wherein the operation member is configured from a cable or rod.

4. The actuator apparatus of claim 1, wherein the first sealing member receiving groove is formed in the front cover, and wherein a first sealing member insertion hole for allowing the sealing member to pass therethrough is formed in the front cover such that the first sealing member receiving groove is formed around the first sealing member insertion hole.

5. The actuator apparatus of claim 1, wherein a first guide part is formed around the first operation member penetrating hole of the first fastening cover, and has an outer portion protruding so as to have a thickness which gradually decreases in the upward direction, and an inner portion extending from the first operation member penetrating hole.

6. The actuator apparatus of claim 1, wherein the second sealing member receiving groove is formed in the second fastening cover, and wherein a second sealing member insertion hole for allowing the sealing member to pass therethrough is formed in the second fastening cover such that the second sealing member receiving groove is formed around the second sealing member insertion hole.

7. The actuator apparatus of claim 1, wherein a second guide part is formed around the second operation member penetrating hole of the piston, wherein an outer portion of the second guide part protrudes so as to have a thickness which gradually decreases in the upward direction, and wherein the second operation member penetrating groove extends inside the second guide part.

8. The actuator apparatus of claim 1, wherein the front cover is integrally formed with the cylinder.

9. The actuator apparatus of claim 1, wherein the hollow member and the operation member inserted through the hollow part are provided in plurality.

10. An actuator apparatus comprising:

a pair of actuators including a first actuator and a second actuator, each of the actuators comprising:

a cylinder having an inner portion filled with a fluid and a front cover for closing a front end portion thereof;

a piston displaced inside the cylinder by the fluid; and a sealing member having a first end portion fixed to the piston and a second end portion fixed to the front cover; and a flexible operation member having a first end portion inserted through the sealing member of the first actuator and fixed to the piston of the first actuator and a second end portion extending out of the front cover of the first actuator, wound around a pulley, and then inserted through the sealing member of the second actuator and fixed to the piston of the second actuator, wherein each sealing member comprises:

a hollow part having a hollow inside; and fixed parts formed to have greater transverse widths than the hollow part, wherein a first fixed part of the fixed parts is fixed to the front cover, and a second fixed part of the fixed parts is fixed to the piston, wherein the first fixed part is fixed by a first fastening cover fastened to the front cover, wherein the second fixed part is fixed by a second fastening cover fixed to the piston, wherein either or both of the front cover and the first fastening cover is provided therein with a first sealing member receiving groove for receiving the first fixed part, wherein either or both of the piston and the second fastening cover is provided with a second sealing member receiving groove for receiving the second fixed part, wherein the first fastening cover is fastened to the front cover so as to cover the first sealing member receiving groove, wherein the second fastening cover is fastened to the piston so s to cover the second sealing member receiving groove, wherein the first fastening cover is provided therein with a first operation member penetrating hole for allowing the operation member to pass therethrough, and wherein the piston is provided therein with a second operation member penetrating hole for allowing the operation member to pass therethrough.

11. The actuator apparatus of claim 10, wherein the sealing member is formed of an elastic material.

12. The actuator apparatus of claim 10, wherein the operation member is configured from a cable.

* * * * *